US006670010B2

(12) United States Patent
Nagamoto et al.

(10) Patent No.: US 6,670,010 B2
(45) Date of Patent: Dec. 30, 2003

(54) COMPOSITE SHEET, METHOD OF PREPARING SAME, AND THERMOSENSITIVE RECORDING ADHESIVE LABEL SHEET HAVING SAME

(75) Inventors: Masanaka Nagamoto, Susono (JP); Masahiro Sato, Sunto-gun (JP); Takeshi Akimoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/200,181

(22) Filed: Jul. 23, 2002

(65) Prior Publication Data

US 2003/0031820 A1 Feb. 13, 2003

(30) Foreign Application Priority Data

Jul. 23, 2001 (JP) ..... 2001-221960

(51) Int. Cl.[7] ..... B32B 29/06

(52) U.S. Cl. ..... 428/41.8; 283/81; 427/372.2; 427/385.5; 427/391; 427/395; 427/411; 428/40.1; 428/41.3; 428/41.4; 428/64.2; 428/537.5; 503/227

(58) Field of Search ..... 428/41.8, 40.1, 428/41.3, 41.4, 64.2, 537.5; 503/227; 427/372.2, 385.5, 391, 395, 411; 283/81

(56) References Cited

U.S. PATENT DOCUMENTS 5,654,039 A 8/1997 Wenzel et al. ..... 427/391

FOREIGN PATENT DOCUMENTS

JP 58-216251 * 12/1983
JP 61-132698 * 6/1986

OTHER PUBLICATIONS

Derwent Abstracts, AN 2000–151171, XP–002236985, JP2000–010485, Jan. 14, 2000.

* cited by examiner

*Primary Examiner*—Nasser Ahmad
(74) *Attorney, Agent, or Firm*—Oblon, Spivak, McClelland, Maier & Neustadt, P.C.

(57) ABSTRACT

A composite sheet including a paper layer made of a wood pulp having a Canadian standard freeness value of 350 to 500 ml and a transmittance of at least 7% for a light with a wavelength of 940 to 960 nm, a transparency improving layer provided over one side of the paper layer so that said paper layer overlaid with said transparency improving layer exhibits a transmittance of at least 11% for a light with a wavelength of 940 to 960 nm, and a release liner provided over an opposite surface of the transparency improving layer from the paper layer. A thermosensitive recording adhesive label sheet has the above composite sheet and a thermosensitive recording sheet provided on the composite sheet through an adhesive layer.

10 Claims, 1 Drawing Sheet

COMPOSITE SHEET, METHOD OF PREPARING SAME, AND THERMOSENSITIVE RECORDING ADHESIVE LABEL SHEET HAVING SAME

BACKGROUND OF THE INVENTION

This invention relates to a composite sheet useful as a disposable backing sheet of a thermosensitive recording adhesive label sheet and to a method of preparing the composite sheet. The present invention is also directed to a thermosensitive recording adhesive label sheet having the composite sheet as a disposable backing sheet thereof.

Recently, thermosensitive recording adhesive labels have been used in a wide variety of fields in the forms of, for example, labels, seals, stickers, tags and emblems. A thermosensitive recording adhesive label sheet is composed of a thermosensitive recording sheet peelably supported on a disposable backing sheet through an adhesive layer. The backing sheet generally includes a paper layer on which a release liner is provided. Wood-free paper, plain paper (e.g. glazed paper or kraft paper) or glassine paper is generally used as the paper layer.

The paper layer of such disposable backing sheets is desired to have improved disintegratability for recycle use. In this respect, glassine paper is ill-suited for recycle use because of its poor disintegratability. To improve disintegratability, proposals have been made in which the freeness of the glassine paper is adjusted. For example, Japanese Laid-Open Patent Publication No. H07-109699 proposes the use of a glassine paper having a Cobb size value (30 seconds) of 35–65 g/m$^2$ and made of a wood pulp having a Canadian standard freeness value of 130 to 240 ml. Japanese Laid-Open Patent Publications No. H09-031898 proposes the use of a treated paper obtained by passing a glassine paper made of a wood pulp having a Canadian standard freeness value of 130 to 240 ml through a nip between a pair of rolls at 10–50 kg/cm, followed by application of an aqueous solution of polyvinyl alcohol. Japanese Laid-Open Patent Publications No. H09-217299 discloses a backing sheet having a glassine paper made of a mixture of 90 to 60 parts by weight of a highly disintegrated pulp having a Canadian standard freeness value of 100 to 250 ml with 10 to 40 parts by weight of a lowly disintegrated pulp having a Canadian standard freeness value of at least 400 ml.

The above backing sheets, which generally show better disintegratability as compared with glassine paper, have a problem because the light transmittance thereof is not good. Namely, label sheets using the above backing sheets are ill-suited for use with printers provided with a light transmission-type label position sensor. To improve the light transmittance, therefore, it is necessary to reduce the thickness of the backing sheet. This results in difficulty in cutting thermosensitive recording medium on the backing sheet into labels and in difficulty in removing cut labels therefrom. While a calendar treatment may improve light transmittance, it is necessary to use a special calendar installation in order to attain a desired level of light transmittance.

The above backing sheets have an additional problem with respect to releasing properties. Namely, when a release liner is formed on the paper layer, pin holes are apt to form in the liner, so that an adhesive coating applied to the release liner penetrates into the backing sheet so that the releasability of labels becomes poor.

To cope with the above problem, Japanese Laid-Open Patent Publication No. H08-144198 proposes the use of paper layer having formed thereon a barrier layer including at least one resin selected from polyacrylamide-acrylate copolymers, styrene-butadiene copolymers and copolymers of polyvinyl alcohol with a polystyrene-acrylate polymer. Japanese Laid-Open Patent Publication No. H10-204795 proposes providing, over a glassine paper, an undercoat layer including a pigment having a particle diameter of 0.4 $\mu$m or less and a water soluble polymer. Japanese Laid-Open Patent Publications No. H11-1897 discloses a backing sheet including a machine glazed paper layer, a coating of a water-soluble polymer provided on the paper layer, and a release liner provided on the polymer coating. The polymer coating has a Cobb size value (60 seconds) of 10 to 40 g/m$^2$ and a Beck's smoothness of 300 to 1000 seconds. Although the release properties of the above backing sheets are improved, the known backing sheets are not fully satisfactory with respect to light transmittance and disintegratability.

SUMMARY OF THE INVENTION

It is, therefore, the prime object of the present invention to provide a composite sheet which is useful as a backing sheet of a thermosensitive recording adhesive label sheet, which is devoid of the drawbacks of the conventional composite sheets and which exhibits both good light transmittance and good disintegratability.

Another object of the present invention is to provide a method of preparing the above composite sheet.

It is a further object of the present invention to provide a thermosensitive recording adhesive label sheet having the above composite sheet as a disposable backing sheet thereof.

In accomplishing the foregoing objects, there is provided in accordance with the present invention a composite sheet comprising a paper layer made of a wood pulp having a Canadian standard freeness value of 350 to 500 ml and a transmittance of at least 7% for a light with a wavelength of 940 to 960 nm, a transparency improving layer provided over one side of said paper layer so that said paper layer overlaid with said transparency improving layer exhibits a transmittance of at least 11% for a light with a wavelength of 940 to 960 nm, and a release liner provided over an opposite surface of said transparency improving layer from said paper layer. In another aspect, the present invention provides a method of preparing the above composite sheet, comprising the steps of:

applying a coating of a transparency improving layer-forming liquid onto a paper layer made of a wood pulp having a Canadian standard freeness value of 350 to 500 ml and a transmittance of at least 7% for a light with a wavelength of 940 to 960 nm to form a transparency improving layer of said paper layer, bringing a heat roller into rolling contact with said transparency improving layer to dry said transparency improving layer so that said paper layer overlaid with said transparency improving layer exhibits a transmittance of at least 11% for a light with a wavelength of 940 to 960 nm, and forming a release liner on an opposite surface of said transparency improving layer from said paper layer.

The present invention further provides a thermosensitive recording adhesive label sheet, comprising the above composite sheet, an adhesive layer provided on said release liner, and a thermosensitive recording sheet provided on said adhesive layer such that said thermosensitive recording sheet with said adhesive layer is peelable from said composite sheet.

BRIEF DESCRIPTION OF DRAWING

Other objects, features and advantages of the present invention will become apparent from the detailed description of the preferred embodiments of the invention which follows, when considered in the light of the accompanying drawing, in which.

DETAILED DESCRIPTION OF THE PREFERRED EMBODIMENTS OF THE INVENTION

Figure 1:
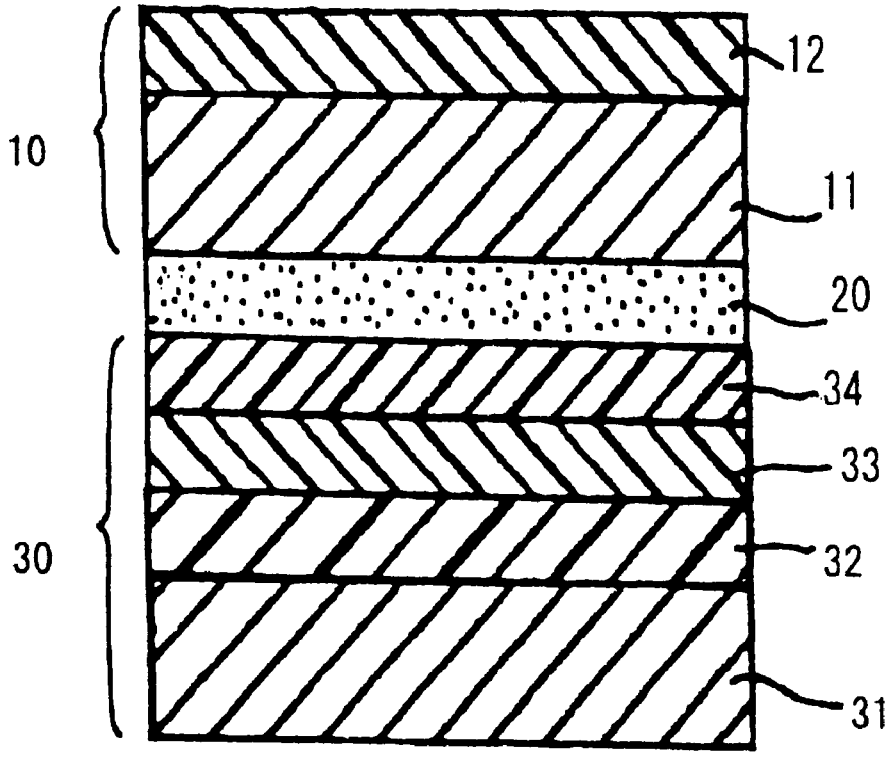
FIG. 1 is a cross-sectional view schematically illustrating a thermosensitive recording adhesive label sheet according to the present invention.

FIG. 1 depicts one preferred embodiment of a thermosensitive recording adhesive label sheet according to the present invention. The thermosensitive recording adhesive label sheet has a thermosensitive recording sheet 10 peelably provided on a disposable backing sheet 30 through an adhesive layer 20. The disposable backing sheet 30 is a composite sheet according to the present invention.

The composite sheet 30 comprises a paper layer 31 and a transparency improving layer 32 provided over one side of the paper layer 31. The paper layer is made of a wood pulp having a Canadian standard freeness value of 350 to 500 ml and a transmittance of at least 7% for a light with a wavelength of 940 to 960 nm. When the freeness is less than 350 ml, it is difficult to obtain satisfactory disintegratability. Too high a freeness beyond 500 ml is undesirable because the light transmittance for a light with a wavelength of 940 to 960 nm is low. At least 7% light transmittance of the paper layer 31 is required in order to obtain satisfactory light transmittance of the composite sheet 30 while maintaining the basis weight of the transparency improving layer 32 small.

The transparency improving layer 32 is provided on one side of the paper layer 31 so that the paper layer 31 combined with the transparency improving layer 32 exhibits a transmittance of at least 11% for a light with a wavelength of 940 to 960 nm. The transparency improving layer 32, which serves to prevent absorption and refraction of light in the paper layer 31, contains a transparency improving agent. The transparency improving agent enters interstices in the paper layer 31 and substitutes for air. Thus, at least a part of, generally a greater part of, the transparency improving layer 32 is impregnated and present in the paper layer 31.

For reasons of enhanced transparency imparting efficiency, the transparency improving agent preferably has a refraction index similar to that of cellulose fiber (about 1.49). Examples of suitable transparency improving agent include sucrose acetate isobutylate, paraffin wax, glyceryl ether of polypropylene glycol, a polyester resin, a styrene resin, an acrylic resin, an amino resin, an urethane resin, polyolefin wax and a hydrogenated petroleum resin. The use of polyolefin wax or a hydrogenated petroleum resin is particularly preferred for reasons of high transparency imparting property.

The amount of the transparency imparting agent is preferably 5 to 30% by weight, more preferably 5 to 20% by weight, based on the basis weight of the paper layer 31, for reasons of satisfactory transparency for the detection by a label position sensor and of maintenance of satisfactory disintegratability of the paper layer 31.

The transparency improving layer 32 may be formed by coating a coating liquid (such as emulsion) containing the transparency improving agent over a surface of the paper layer 31.

Provided on the transparency improving layer 32 is a release liner 34. The release liner 34 contains a release agent such as a silicone resin, a fluorine resin, an aminoalkyd resin or a polyester resin. The release liner 34 may be formed by applying a coating liquid or solid by an emulsion, solution or solventless coating method. A solventless addition curable silicone is preferably used for reasons of safety, low costs, non-pollution and good release properties.

It is preferred that a buffer layer 33 be provided over the transparency improving layer 32 before the application of a coating of the release liner 34, so that the release liner 34 can be prevented from penetrating into the transparency improving layer 32 and, therefore, can be uniformly formed into a thin layer. The barrier layer 33 comprises a barrier substance which may be a water soluble polymer or a water insoluble polymer.

Examples of the water soluble polymer include polyvinyl alcohol, starch and derivatives thereof, cellulose derivatives such as methoxy cellulose, hydroxy cellulose, carboxymethyl cellulose, methyl cellulose and ethyl cellulose, sodium polyacrylate, polyvinyl pyrrolidone, acrylamide-acrylic ester copolymer, acrylamide-acrylic ester-methacrylic acid terpolymer, alkali salts of styrene-maleic anhydride copolymer, alkali salts of isobutylene-maleic anhydride copolymer, polyacrylamide, sodium alginate, gelatin, and casein. Examples of the water insoluble polymer include latexes of styrene-butadiene copolymer and styrene-butadiene-acrylic copolymer; and emulsions of vinyl acetate resin, vinyl acetate-acrylic acid copolymer, styrene-acrylic ester copolymer, acrylic ester resin, and polyurethane resin. A pigment such as clay or silica may be incorporated into the buffer layer in such an amount that the at least 11% of light transmittance of the resulting composite sheet 30 is ensured for a light with a wavelength of 940 to 960 nm.

In lieu of providing the barrier layer, similar effect may be also obtained when the above barrier substance is incorporated into the transparency improving layer 32. In this case, a pigment such as clay or silica may be incorporated into the transparency improving layer 32.

The surface on which the release liner 34 is formed is preferably subjected to a smoothing treatment before the application of the release liner 34. The smoothing treatment, which can also improve light transmittance, may be a calendaring treatment or a heat-roll treatment. The calendaring may be machine calendar, super calendar, soft calender, gloss calendar or matte calendar. The control of the smoothness may be either off-machine or on-machine. The calendaring conditions may be suitably selected according to the aimed thickness and aimed light transmittance. The heat roll treatment may be carried out by bringing the heat roll at preferably 90° C. or more into rolling contact with the surface to be treated. The surface to be treated by calendar or heat roll may be the transparency improving layer 32 or, if provided, the barrier layer 33.

The composite sheet 30 thus constructed may be used as a disposable sheet for any adhesive label sheet such as a thermosensitive recording adhesive label sheet, an ink jet printing adhesive label sheet, a laser printing adhesive label sheet or a thermal transfer image receiving adhesive label sheet. Description will be next made of a thermosensitive recording adhesive label sheet.

Referring still to FIG. 1, one the release liner 34 of the composite sheet 30 is provided a thermosensitive recording sheet 10 through an adhesive layer 20. The thermosensitive recording sheet 10 comprises a support 11 provided on the adhesive layer 20, and a thermosensitive recording layer 12 provided on the support 11. The thermosensitive coloring layer comprises a coloring composition which can induce color formation by the application of heat thereto. For instance, the above-mentioned coloring composition comprises a coloring agent such as a leuco dye, and a color developer.

The thermosensitive recording layer 12 contains one or more leuco dyes as a coloring agent. Suitable leuco dyes for use in the coloring layer, which may be employed alone or in combination, include any known leuco dyes for use in the conventional thermosensitive recording materials. For example, triphenylmethane-type leuco compounds, fluoran-type leuco compounds, phenothiazine-type leuco compounds, auramine-type leuco compounds, spiropyran-type leuco compounds, and indolinophthalide-type leuco compounds are preferably employed.

Specific examples of such leuco dyes include:

3,3-bis(p-dimethylaminophenyl)phthalide,
3,3-bis(p-dimethylaminophenyl)-6-dimethylaminophthalide (i.e., Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethyifluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthyl] benzoic acid lactam,
3-diethylamino-6-methyl-7-(m-trichloromethylanilino) fluoran,
3-diethylamino-7-(o-chloroanilino)fluoran,
3-di-n-butylamino-7-(o-chloroanilino)fluoran,
3-(N-methyl-N-n-amylamino)-6-methyl-7-anilinofluoran,
3-(N-methyl-N-cyclohexylamino)-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxybenzoindolino spiropyran,
6'-bromo-3'-methoxybenzoindolino spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-diethylamino-6-methyl-7-(2',4'-dimethylanilino)fluoran,
3-(2'-methoxy-4'-dimethylaminophenyl)-3-(2'-hydroxy-4'-chloro-5'-methylphenyl)phthalide,
3,6-bis(dimethylamino)fluorenespiro(9,3')-6'-dimethylaminophthalide,
3-(p-dimethylaminophenyl)-3-{1,1-bis(p-dimethylaminophenyl)ethylene-2-yl}phthalide,
3-(p-dimethylaminophenyl)-3-{1,1-bis(p-dimethylaminophenyl)ethylene-2-yl}-6-dimethylaminophthalide,
3-(p-dimethylaminophenyl)-3-(1-p-dimethylaminophenyl)-1-phenylethylene-2-yl}phthalide,
3-(p-dimethylaminophenyl)-3-(1-p-dimethylamino-1-p-chlorophenylethylene-2-yl}-6-dimethylaminophthalide,
3-(4'-dimethylamino-2'-methoxy)-3-(1"-p-dimethylaminophenyl-1"-p-chlorophenyl-1",3"-butadiene-4"-yl)benzophthalide,
3-(4'-dimethylamino-2'-benzyloxy)-3-(1"-p-dimethylaminophenyl-1"-phenyl-1",3"-butadiene-4"-yl) benzophthalide,
3-dimethylamino-6-dimethylaminofluorene-9-spiro-3'-(6'-dimethylaminophthalide,
3,3-bis{2-(p-dimethylaminophenyl)-2-(p-methoxyphenyl) ethenyl}4,5,6,7-tetrachlorophthalide,
3-bis{1,1-bis(4-pyrrolidinophenyl)ethylene-2-yl-5,6-dichloro-4,7-dibromophthalide,
bis(p-dimethylaminostyryl)-1-naphthalenesulfonylmethane,
3-(N-ethyl-N-tetrahydrofurfurylamino)-6-methyl-7-anilinofluoran,
3-(N-ethyl-N-2-ethoxypropylamino)-6-methyl-7-anilinofluoran,
3-N-methyl-N-isobutyl-6-methyl-7-anilinofluoran,
3-morphorino-7-(N-propyltrifluoromethylanilino)fluoran,
3-pyrrolidino-7-trifluoromethylanilinofluoran,
3-diethylamino-5-chloro-7-(N-benzyltrifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino) fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino) fluoran,
3-(N-methyl-N-isopropylamino)-6-methyl-7-anilinofluoran,
3-di-n-butylamino-6-methyl-7-anilinofluoran,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4',5'-benzofluoran,
3-N-methyl-N-isopropyl-6-methyl-7-anilinofluoran,
3-N-ethyl-N-isoamyl-6-methyl-7-anilinofluoran, and
3-diethylamino-6-methyl-7-(2',4'-dimethylanilino)fluoran.

The thermosensitive recording layer also contains a developer. Any conventional electron acceptor or oxidizing agent which works upon the above-mentioned leuco dyes to induce color formation, such as phenol compounds, thiophenol compounds, thiourea compounds, organic acids and metal salts of organic acids, can be employed. Specific examples of such color developers include:

4,4'-isopropylidenediphenol,
3,4'-isopropylidenebisphenol,
4,4'-isopropylidenebis(o-methylphenol),
4,4'-sec-butylidenebisphenol,
4,4'-isopropylidenebis(2-tert-butylphenol),
2,2'-methylenebis(4-ethyl-6-tert-butylphenol),
zinc p-nitrobenzoate,
1,3,5-tris(4-tert-butyl-3-hydroxy-2,6-dimetylbenzyl) isocyanuric acid,
2,2-(3,4'-dihydroxydiphenyl)propane,
11,3-bis(4-hydroxyphenylthio)-2-hydroxypropane,
bis(4-hydroxy-3-methylphenyl)sulfide,
4-[β-(p-methoxyphenoxy)ethoxy]salicylate,
1,7-bis(4-hydroxyphenylthio)-3,5-dioxaheptane,
1,5-bis(4-hydroxyphenylthio)-5-oxapentane,
monocalcium salt of monobenzylphthalate,
4,4'-cyclohexylidenediphenol,
4,4'-isopropylidenebis(2-chlorophenol),
2,2'-methylenebis(4-methyl-6-tert-butylphenol),
4,4'-butylidenebis(6-tert-butyl-2-methyl)phenol, 1,1,3-tris(2-methyl-4-hydroxy-5-tert-butylphenyl)butane,
1,1,3-tris(2-methyl-4-hydroxy-5-cyclohexylphenyl)butane,
4,4'-thiobis(6-tert-butyl-2-methyl)phenol,
4,4'-diphenolsulfone,
4,2'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)propane,
N,N'-diphenylthiourea,
N,N'-di(m-chlorophenyl)thiourea,
salicylanilide,
5-chlorosalicylanilide,
salicyl-o-chloroanilide,
bis(4-hydroxyphenyl)methyl acetate,
bis(4-hydroxyphenyl)benzyl acetate,
1,3-bis(4-hydroxycumyl)benzene,
1,4-bis(4-hydroxycumyl)benzene,
2,4'-diphenolsulfone,
3,3'-diallyl-4,4'-diphenolsulfone,
3,4-dihydroxy-4'-methyldiphenylsulfone,
antipyrin complex of zinc thiocyanate,
2-hydroxy-3-naphthoic acid,
2-hydroxy-1-naphthoic acid,
1-hydroxy-2-naphthoic acid,
metal (zinc, aluminum, calcium, etc.) salts of hydroxynaphthoic acid,
zinc 1-acetyloxy-2-naphthoate,
zinc 2-acetyloxy-1-naphthoate,
zinc 2-acetyloxy-3-naphthoate,
α,α-bis(4-hydroxyphenyl)-α-methyltoluene,
tetrabromobisphenol A,
tetrabromobisphenol S,
4,4'-thiobis(2-methylphenol), and
4,4'-thiobis(2-chlorophenol).

These developers are employed alone or in combination.

The developer is used in an amount of from about 1 to about 20 parts, more preferably from about 2 to about 10 parts by weight, per 1 part by weight of the coloring agent.

The thermosensitive coloring layer may further comprise a binder resin. Particularly, binder resins having a hydroxyl group or carboxyl group in a molecule thereof are preferably employed. Specific examples of the above-mentioned binder resin for use in the thermosensitive coloring layer are polyvinyl butyral, polyvinyl acetal such as polyvinyl acetoacetal, cellulose derivatives such as ethyl cellulose, cellulose acetate, cellulose acetate propionate and cellulose acetate butyrate, and epoxy resin. Those binder resins can be used alone or in combination.

The thermosensitive recording layer may contain a heat-fusible material preferably having a melting point of 50–200° C. Illustrative of suitable heat-fusible material are fatty acids such as stearic acid and behenic acid; fatty acid esters; fatty amides such as stearamide and palmitamide; fatty acid salts such as zinc stearate, calcium stearate, aluminum stearate, zinc plamitate and zinc behenate; and waxes such as stearate wax, polyethylene wax, carnauba wax, microcrystalline wax and carboxyl-modified paraffin wax, condensation products of an aromatic carboxylic acid with an amine; phenyl benzoate; higher straight chain glycols; dialkyl 3,4-epoxy-hexahydrophthalates; and higher ketones.

The thermosensitive recording layer may additionally contains various conventionally employed additives such as a surfactant, an organic or inorganic filler, an gent for preventing coloring of the leuco dye by pressure, and a lubricant.

Examples of fillers include silica, zinc oxide, aluminum hydroxide, zinc hydroxide, barium sulfate, kaolin, clay, talc, calcium carbonate, magnesium carbonate, calcined clay, titanium oxide, diatomaceous earth, anhydrous silica, activated clay, surface treated calcium, surface treated silica, vinylidene chloride resin powder, styrene-methacrylic acid copolymer powder, nylon powder, polyethylene powder, polystyrene powder and urea-formaldehyde resin powder. Examples of the lubricant include Examples of the lubricant for use in the thermosensitive recording layer include higher fatty acids and metallic salts thereof, higher fatty amides, higher fatty acid esters, and a variety of waxes such as an animal wax, a vegetable wax, a mineral wax and a petroleum wax.

The thermosensitive recording layer may be formed on a substrate by any customarily employed method. For example, the above-described leuco dye, developer and an aqueous solution or dispersion of a binder are ground with a ball mill, an attriter or a sand mill into a particle size of 10 μm or less, preferably 5 μm or less, more preferably 1 μm or less. The resulting dispersion is then mixed with other additives such as a filler and a heat-fusible material to obtain a coating liquid. The coating liquid is applied onto the substrate and dried to form the thermosensitive recording layer thereon.

The thickness of the thermosensitive coloring layer, which depends on the formulation for the thermosensitive recording layer and intended use of the obtained thermosensitive recording adhesive label sheet, is preferably in the range of about 1 to 50 μm, and more preferably about 3 to 20 μm.

If desired, the thermosensitive recording layer may be overlaid with a protective layer for the purpose of improving the chemical resistance, water resistance, wear resistance, light resistance, surface smoothness, transparency and head-matching properties thereof. The protective layer for use in the present invention may be a film comprising as the main component a water-soluble resin or hydrophobic resin, or a film comprising as the main component an ultraviolet-curing resin or electron-beam curing resin.

Examples of the water-soluble resin for use in the protective layer are polyvinyl alcohol, modified polyvinyl alcohol, cellulose derivatives such as methyl cellulose, methoxy cellulose and hydroxy cellulose, casein, gelatin, polyvinyl pyrrolidone, styrene-maleic anhydride copolymer, diisobutylene-maleic anhydride copolymer, polyacrylamide, modified polyacrylamide, methyl vinyl ether-maleic anhydride copolymer, carboxyl-modified polyethylene, polyvinyl alcohol-polyacrylamide block copolymer, melamine-formaldehyde resin, and urea-formaldehyde resin. Examples of the resin for an aqueous emulsion and the hydrophobic resin for use in the protective layer include polyvinyl acetate, polyurethane, styrene-butadiene copolymer, styrene-butadiene-acrylic copolymer, polyacrylic acid, polyacrylic ester, vinyl chloride-vinyl acetate copolymer, polybutyl methacrylate, polyvinyl butyral, polyvinyl acetal, ethyl cellulose, and ethylene-vinyl acetate copolymer. Further, a copolymer comprising a monomer constituting the above-mentioned resins and a silicone segment may also be preferably employed. Those resins may be used alone or in combination. When necessary, the resin may be cured using a curing agent. The ultraviolet-curing resin for use in the protective layer is prepared by polymerizing a monomer, oligomer or prepolymer which is polymerizable to form a cured resin by the application of ultraviolet light thereto. There are no limitations on such a monomer, oligomer or prepolymer for the preparation of the ultraviolet-curing resin for use in the protective layer, but conventional monomers, oligomers, or prepolymers can be employed. There are no particular limitations on the electron-beam curing resin for use in the protective layer. An electron-beam curing resin comprising a polyester skeleton with a five or more functional branched molecular structure, and a silicone-modified electron-beam curing resin are preferred in the present invention.

For the purpose of further improving the matching properties of the obtained recording label to a thermal head, the protective layer may further comprise an inorganic and organic filler, and a lubricant so long as the surface smoothness of the protective layer is not decreased. It is preferable that the particle size of the filler for use in the protective layer be 0.3 $\mu$m or less. Further, the oil absorption of the filler is preferably 30 ml/100 g or more, and more preferably, 80 ml/100 g or more. The above-mentioned inorganic and organic filler for use in the protective layer, which may be used alone or in combination, can be selected from any pigments used in the conventional thermosensitive recording materials. Specific examples of the inorganic pigment for use in the protective layer are calcium carbonate, silica, zinc oxide, titanium oxide, aluminum hydroxide, zinc hydroxide, barium sulfate, clay, talc, and surface-treated calcium and silica. Specific examples of the organic pigment for use in the protective layer are urea-formaldehyde resin, styrene-methacrylic acid copolymer and polystyrene resin. The lubricant described with reference to the thermosensitive recording layer may be also used in the protective layer.

The protective layer may be provided by any of the conventional coating methods. It is preferable that the thickness of the protective layer be in the range of 0.1 to 20 $\mu$m, and more preferably in the range of 0.5 to 10 $\mu$m. When the thickness of the protective layer is within the above-mentioned range, the functions of the protective layer, that is, the improvements of preservation stability of the recording label and head-matching properties of the thermosensitive coloring layer can be sufficiently expected, and the decrease of thermal sensitivity of the thermosensitive recording layer can be prevented.

A heat insulating layer (not shown) may be suitably interposed between the support 11 and the adhesive layer 20 and/or between the support 11 and the thermosensitive recording layer 12 for the purpose of improving heat-sensitivity of the thermosensitive recording layer 12. The heat insulating layer interposed between the support 11 and the thermosensitive recording layer 12 may also serve to prevent heat for heating and activating the adhesive layer 20 from conducting to the thermosensitive recording layer 12 so that the background coloring of the thermosensitive recording layer 12 during non-printing stage can be prevented.

The heat insulating layer comprises a binder, insulating particles and, if necessary, additives such as filler, heat fusible substance, pigment and surfactant.

Specific examples of the binder for the heat insulating layer include latexes such as styrene-butadiene rubbers (SBR), methyl methacrylate-butadiene copolymers (MBR) and acrylonitrile-butadiene rubbers (NBR); water soluble resins such as polyvinyl alcohol, carboxy modified polyvinyl alcohol, amino modified polyvinyl alcohol, epoxy modified polyvinyl alcohol, cellulose derivatives, starch and derivatives thereof, polyacrylic acid and derivatives thereof, styrene-acrylic acid copolymers, poly(meth)acrylamide and derivatives thereof, polyethylene imine, and isobutylene-maleic anhydride copolymers and derivatives thereof.

Examples of the filler for use in the heat insulating layer include inorganic fillers such as calcium carbonate, silica, zinc oxide, titanium oxide, aluminumhydroxide, zinchydroxide, bariumsulfate, clay, talc, surface treated silica and calcium carbonate; and organic fillers such as urea-formaldehyde resins, styrene-methacrylic acid copolymers, polystyrene resins and the like.

The insulating particles may be (a) minute void particles with a voidage of 30% or more, each made of a thermoplastic resin as its shell, (b) porous pigment particles or (c) expanded filler.

The minute void particles with a voidage of 30% or more are minute particles expanded so that air or other gases are contained therewithin. The minute void particles with a number average particle size of 2 to 20 $\mu$m, preferably 3 to 10 $\mu$m are employed. When the number average particle diameter (outer diameter) of the minute void particles is 2 $\mu$m or less, void particles with a desired voidage cannot be easily produced. When the number average particle diameter of the minute void particles is 20 $\mu$m or more, the surface smoothness of the obtained insulating layer is lowered. It is preferred that the minute particles be classified to have a uniform particle size.

The voidage of the minute void particles for use in the insulating layer is 30% or more, preferably 50% or more. When the insulating layer interposed between the support and the heat activatable adhesion layer has a voidage of 30% or less, sufficient insulating properties cannot be obtained, so that the thermal energy applied to the adhesive layer by a heating medium for heat activation cannot be efficiently used for heat activation thereof and, hence, improvement in adhesion cannot be attained.

The term "voidage" of minute void particles herein is intended to refer to a percentage obtained by the following formula:

$$\text{Voidage}(\%)=DI/DO\times 100$$

wherein DI and DO represent the inner and outer diameters of the void particles, respectively.

The minute void particles are formed of a thermoplastic resin which constitutes shells thereof, as previously mentioned. As the above-mentioned thermoplastic resin, a copolymer resin containing as major components vinylidene chloride and acrylonitrile is preferably employed.

Examples of the porous pigment for use in the insulating layer include organic pigments such as urea-formaldehyde resin, and inorganic pigments such as shirasu clay.

The insulating layer may be formed on the support or on the release liner as follows. The above-mentioned minute void particles or porous pigment particles are dispersed in water together with a binder to obtain a coating liquid. The coating liquid thus prepared is then coated on the substrate and dried to obtain the insulating layer formed on the substrate. In this case, the deposition amount of the minute void particles is preferably at least 1 g/m$^2$, more preferably in the range of about 2 to 15 g/m$^2$. The binder is generally used in an amount of 2 to 50% by weight based on the total weight of the minute void particles and the binder.

The following examples will further illustrate the present invention. Parts and percentages are by weight.

EXAMPLE 1

A transparency improving layer forming liquid having the formulation shown below was applied to a surface of a paper (basis weight: 47 g/m$^2$; thickness: 60 $\mu$m; transmittance of light with a wavelength of 940–960 nm: 9.5%) obtained from wood pulp having a Canadian standard freeness value of 400 ml to form a transparency improving layer having a basis weight of 7 g/m$^2$ (on dry basis) on the paper.

Transparency Improving Layer Forming Liquid:

Hydrogenated petroleum resin (emulsion; solid content: 40%) 30 parts

Aqueous polyvinyl alcohol solution (10% solution) 30 parts

Water 40 parts

The thus obtained paper having the transparency improving layer was subjected to calendaring (pressure: 25 kg/cm$^2$; speed: 15 m/sec), to which was then applied a release liner coating material having the following formulation, thereby obtaining a composite sheet:

Release Liner Coating Material:

Solventless addition curable silicone 100 parts

Curing catalyst 1.5 parts

To the thus obtained composite sheet, an acrylic pressure sensitive adhesive (solid content: 54%; commercially available from Japan NSC Co., Ltd.) was applied in an amount of 18 g/m$^2$ (on dry basis) so that an adhesive layer was provided on the release liner of the composite sheet. A thermosensitive recording sheet (130LAB-1 manufactured by Ricoh Company, Ltd.) was then bonded to the composite sheet such that the support of the recording sheet was in contact with the adhesive layer of the composite sheet, thereby obtaining a thermosensitive recording adhesive label sheet.

EXAMPLE 2

Example 1 was repeated in the same manner as described except that paraffin wax emulsion (solid content: 40%) was substituted for the hydrogenated petroleum resin emulsion, thereby obtaining a thermosensitive recording adhesive label sheet.

EXAMPLE 3

Example 1 was repeated in the same manner as described except that acrylic resin emulsion (solid content: 40%) was substituted for the hydrogenated petroleum resin emulsion, thereby obtaining a thermosensitive recording adhesive label sheet.

EXAMPLE 4

A transparency improving layer forming liquid having the formulation shown below was applied to a surface of a paper (basis weight: 47 g/m$^2$; thickness: 60 $\mu$m; transmittance of light with a wavelength of 940–960 nm: 9.5%) obtained from wood pulp having a Canadian standard freeness value of 400 ml to form a transparency improving layer having a basis weight of 7 g/m$^2$ (on dry basis).

Transparency Improving Layer Forming Liquid:

Hydrogenated petroleum resin (emulsion; solid content: 40%) 30 parts

Water 40 parts

To the transparency improving layer was then applied an aqueous polyvinyl alcohol solution (10% solution) to form thereon a barrier layer having a basis weight of 1 g/m$^2$ (on dry basis). The barrier layer was subjected to calendaring (pressure: 25 kg/cm$^2$; speed: 15 m/sec), to which a release liner was applied in the same manner as that in Example 1 to obtain a composite sheet. Using this composite sheet a thermosensitive recording adhesive label sheet was prepared in the same manner as that in Example 1.

EXAMPLE 5

Example 1 was repeated in the same manner as described except that the calendaring treatment was not performed, thereby obtaining a thermosensitive recording adhesive label sheet.

EXAMPLE 6

Example 1 was repeated in the same manner as described except that the amount of the transparency improving layer was changed to 4 g/m$^2$ (on dry basis), thereby obtaining a thermosensitive recording adhesive label sheet.

EXAMPLE 7

Example 1 was repeated in the same manner as described except that the amount of the transparency improving layer was changed to 14 g/m$^2$ (on dry basis), thereby obtaining a thermosensitive recording adhesive label sheet.

EXAMPLE 8

Example 1 was repeated in the same manner as described except that the amount of the transparency improving layer was changed to 4 g/m$^2$ (on dry basis) and that the calendar pressure was increased to 50 kg/cm$^2$, thereby obtaining a thermosensitive recording adhesive label sheet.

EXAMPLE 9

Example 1 was repeated in the same manner as described except that the calendaring treatment was substituted by a heat roll treatment (drying temperature: 100° C.; speed: 15 m/sec), thereby obtaining a thermosensitive recording adhesive label sheet.

EXAMPLE 10

Example 1 was repeated in the same manner as described except that a paper (basis weight: 50 g/m$^2$; thickness: 65 $\mu$m; transmittance of light with a wavelength of 940–960 nm: 7.5%) obtained from wood pulp having a Canadian standard freeness value of 400 ml was substituted for the paper having a transmittance of 9.5%, thereby obtaining a thermosensitive recording adhesive label sheet.

EXAMPLE 11

Example 1 was repeated in the same manner as described except that a paper (basis weight: 46 g/m$^2$; thickness: 58 $\mu$m; transmittance of light with a wavelength of 940–960 nm: 10%) obtained from wood pulp having a Canadian standard freeness value of 370 ml was substituted for the paper having a transmittance of 9.5%, thereby obtaining a thermosensitive recording adhesive label sheet.

COMPARATIVE EXAMPLE 1

Example 1 was repeated in the same manner as described except that a paper (basis weight: 60 g/m$^2$; thickness: 80 $\mu$m; transmittance of light with a wavelength of 940–960 nm: 6%) obtained from wood pulp having a Canadian standard freeness value of 400 ml was substituted for the paper having a transmittance of 9.5%, thereby obtaining a thermosensitive recording adhesive label sheet.

COMPARATIVE EXAMPLE 2

Example 1 was repeated in the same manner as described except that the hydrogenated petroleum resin (emulsion; solid content: 40%) of the transparency improving layer forming liquid was not used, thereby obtaining a thermosensitive recording adhesive label sheet.

COMPARATIVE EXAMPLE 3

To a glassine paper (transmittance of light with a wavelength of 940–960 nm: 12%) obtained from wood pulp having a Canadian standard freeness value of 270 ml, a release liner coating material having the same formulation as that of Example 1 was coated, thereby obtaining a composite sheet. Using this composite sheet, a thermosensitive recording adhesive label sheet was prepared in the same manner as that in Example 1.

COMPARATIVE EXAMPLE 4

To a glassine paper (transmittance of light with a wavelength of 940–960 nm: 19%) obtained from wood pulp having a Canadian standard freeness value of 150 ml, a release liner coating material having the same formulation as that of Example 1 was coated, thereby obtaining a composite sheet. Using this composite sheet, a thermosensitive recording adhesive label sheet was prepared in the same manner as that in Example 1.

COMPARATIVE EXAMPLE 5

A barrier layer forming liquid having the formulation shown below was applied to a surface of a paper (basis weight: 47 g/m$^2$; thickness: 60 $\mu$m; transmittance of light with a wavelength of 940–960 nm: 9.5%) obtained from wood pulp having a Canadian standard freeness value of 400 ml to form a barrier layer having a basis weight of 7 g/m$^2$ (on dry basis) on the paper, thereby obtaining a composite sheet.

Barrier Layer Forming Liquid:

Paraffin wax (emulsion; solid content: 40%) 0.1 part

Aqueous polyvinyl alcohol solution (10% solution) 40 parts

Water 59.9 parts

Using this composite sheet, a thermosensitive recording adhesive label sheet was prepared in the same manner as that in Example 1.

Each of the thermosensitive recording adhesive label sheets was measured for the light transmittance, detectability by label position sensor, disintegratability and peelability according to the following methods. The results are shown in Table 1.

(1) Transmittance:

A spectrophotometer was used to measure a transmittance of light with a wavelength in the range of 940 to 960 nm.

(2) Detectability by Label Position Sensor:

Each of the thermosensitive recording adhesive label sheets obtained above was subjected to die cutting to cut the thermosensitive recording sheet provided on the composite sheet into labels. The label sheet was then printed using a label printer (Model 3600XT manufactured by Teraoka Seiko Co., Ltd.) to check whether the label was suitably detected by a position sensor of the label printer. The detectability was evaluated by the following ratings:

Yes: detectable

No: not detectable (3) Disintegratability:

Each of the thermosensitive recording adhesive label sheets from which the thermosensitive recording sheet (labels) was peeled off was subjected to a disintegration treatment using a disintegrating device according to Japanese Industrial Standard JIS P8209. The disintegratability was evaluated according to the following ratings:

A: good disintegratability (easily recyclable)

B: fair disintegratability (recyclable)

C: no good disintegratability (not recyclable)

(4) Peelability:

Labels (size: 40×60 mm) were peeled off from the composite sheet with fingers to evaluate the peelability according to the following ratings:

A: good peelability

B: fair peelability

C: no good peelability

TABLE 1

| Example | Transmittance (%) 940 nm | 960 nm | Adaptability | Disintegratability | Peelability |
|---|---|---|---|---|---|
| 1 | 11.8 | 12.0 | Yes | A | A |
| 2 | 12.0 | 12.2 | Yes | A | A |
| 3 | 11.5 | 11.7 | Yes | A | A |
| 4 | 11.9 | 12.1 | Yes | A | B |
| 5 | 11.3 | 11.5 | Yes | A | A |
| 6 | 11.1 | 11.3 | Yes | A | B |
| 7 | 12.1 | 12.3 | Yes | B | A |
| 8 | 12.0 | 12.2 | Yes | A | A |
| 9 | 11.5 | 11.7 | Yes | A | A |
| 10 | 11.0 | 11.2 | Yes | A | A |
| 11 | 12.4 | 12.7 | Yes | A | A |
| Comp. 1 | 10.5 | 10.7 | No | A | A |
| Comp. 2 | 9.8 | 10.0 | No | A | C |
| Comp. 3 | 12.3 | 12.5 | Yes | C | A |
| Comp. 4 | 20.5 | 20.8 | Yes | C | A |
| Comp. 5 | 9.5 | 9.7 | No | A | A |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Application No. 2001-221960, filed Jul. 23, 2001, inclusive of the specification, claims and drawings, are hereby incorporated by reference herein.

What is claimed is:

1. A composite sheet comprising a paper layer made of a wood pulp having a Canadian standard freeness value of 350 to 500 ml and a transmittance of at least 7% for a light with a wavelength of 940 to 960 nm, a transparency improving layer provided over one side of said paper layer so that said paper layer overlaid with said transparency improving layer exhibits a transmittance of at least 11% for a light with a wavelength of 940 to 960 nm, and a release liner provided over an opposite surface of said transparency improving layer from said paper layer.

2. A composite sheet as claimed in claim 1, wherein said release liner comprises a solventless addition curable silicone.

3. A composite sheet as claimed in claim 1, wherein said transparency improving layer comprises an transparency imparting agent selected from the group consisting of a hydrogenated petroleum resin and a polyolefin wax.

4. A composite sheet as claimed in claim 1, wherein said transparency imparting agent is present in an amount of 5 to 30% by weight based on the basis weight of the paper layer.

5. A composite sheet as claimed in claim 1, wherein said transparency improving layer further comprises a barrier substance.

6. A composite sheet as claimed in claim 5, wherein said barrier substance is a polymeric material selected from the group consisting of polyvinyl alcohol, starch, carboxymethyl cellulose, a styrene-butadiene rubber and an acrylic polymer.

7. A composite sheet as claimed in claim 1, further comprising a barrier layer interposed between said transparency improving layer and a release liner.

8. A composite sheet as claimed in claim 7, wherein said barrier layer comprises a polymeric material selected from the group consisting of polyvinyl alcohol, starch, carboxymethyl cellulose, a styrene-butadiene rubber and an acrylic polymer.

9. A thermosensitive recording adhesive label, comprising a composite sheet according to claim 1, an adhesive layer provided on said release liner, and a thermosensitive recording sheet provided on said adhesive layer such that said thermosensitive recording sheet with said adhesive layer is peelable from said composite sheet.

10. A method of preparing a composite sheet according to claim 1, comprising the steps of:

applying a coating of a transparency improving layer-forming liquid onto a paper layer made of a wood pulp having a Canadian standard freeness value of 350 to 500 ml and a transmittance of at least 7% for a light with a wavelength of 940 to 960 nm to form a transparency improving layer of said paper layer, bringing a heat roller into rolling contact with said transparency improving layer to dry said transparency improving layer so that said paper layer overlaid with said transparency improving layer exhibits a transmittance of at least 11% for a light with a wavelength of 940 to 960 nm, and forming a release liner on an opposite surface of said transparency improving layer from said paper layer.

* * * * *